United States Patent [19]

Allen

[11] Patent Number: 4,468,030

[45] Date of Patent: Aug. 28, 1984

[54] ROTATING SELECTIVE ELEMENT GAME APPARATUS

[76] Inventor: David L. Allen, 447 W. Sunset Cir., Mesa, Ariz. 85201

[21] Appl. No.: 449,162

[22] Filed: Dec. 13, 1982

[51] Int. Cl.[3] ..... A63B 7/02

[52] U.S. Cl. ..... 273/109; 273/120 R

[58] Field of Search ..... 273/119 R, 120 R, 120 A, 273/118 R, 109, 117, 142 R, 142 D, 142 E, 142 F, 142 G, 144 R, 144 A, 144 B

[56] References Cited

U.S. PATENT DOCUMENTS

| | | | |
|---|---|---|---|
| 449,140 | 3/1891 | Scott et al. | 273/119 R X |
| 480,872 | 8/1892 | Kemble | 273/109 |
| 1,066,107 | 7/1913 | Halliday | 273/120 R |
| 1,378,241 | 5/1921 | Keckeis | 273/120 R |
| 1,468,984 | 9/1923 | Weaver | 273/119 R X |
| 1,524,378 | 1/1925 | Antes | 273/120 R |
| 1,537,236 | 5/1925 | Jarvis | 273/142 G |
| 1,824,647 | 9/1931 | Wright | 273/142 F |
| 2,811,362 | 10/1957 | Barteither | 273/142 E |
| 2,954,230 | 9/1960 | Rogers | 273/117 |

FOREIGN PATENT DOCUMENTS

| | | | |
|---|---|---|---|
| 345988 | 1/1921 | Fed. Rep. of Germany | 273/142 G |
| 305747 | 5/1955 | Switzerland | 273/142 F |
| 459031 | 8/1968 | Switzerland | 273/120 R |

*Primary Examiner*—Richard C. Pinkham
*Assistant Examiner*—Scott L. Brown
*Attorney, Agent, or Firm*—H. Gordon Shields

[57] ABSTRACT

Game apparatus includes a bowl having a sloping floor and a receptacle centered beneath the floor, and a rotating element having an opening therein through which rolling elements may be selectively admitted or dropped into the receptacle, is disposed above the receptacle. At least two different types or colors of rolling elements are disposed on the floor and may be selectively allowed to fall into the receptacle to the intended exclusion of others of the rolling elements, thus comprising a game of skill and coordination.

8 Claims, 7 Drawing Figures

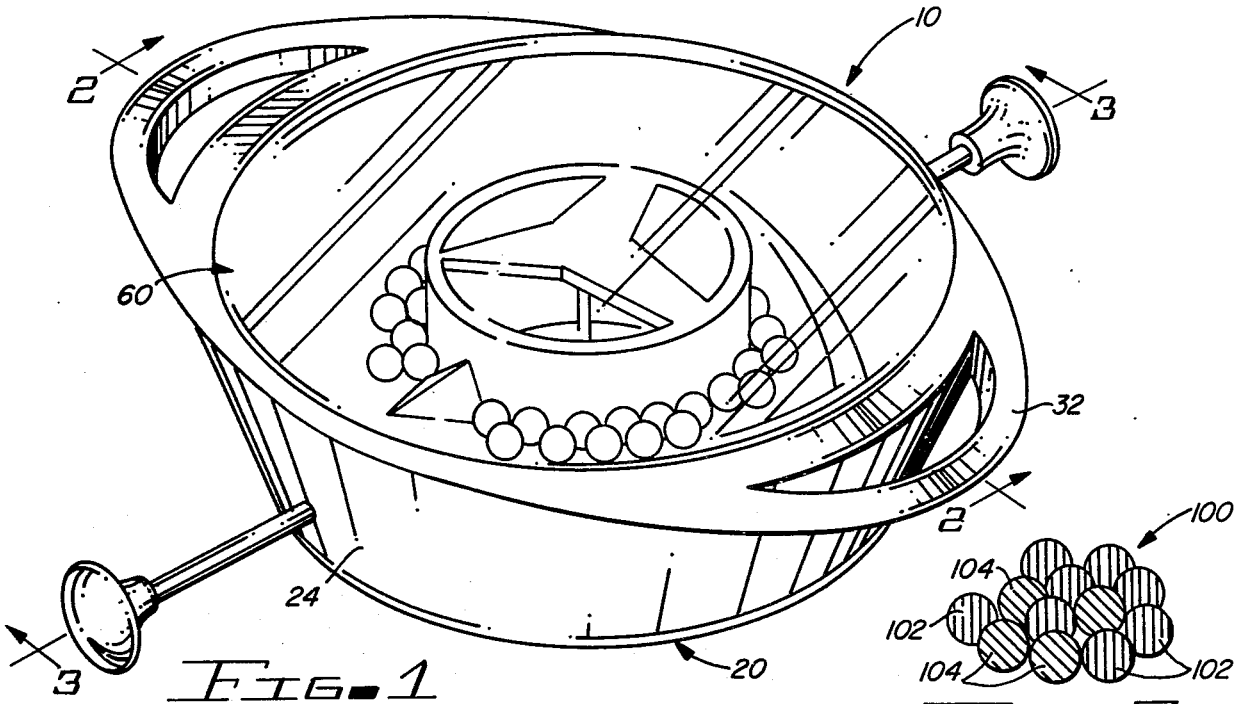
FIG. 1
FIG. 7
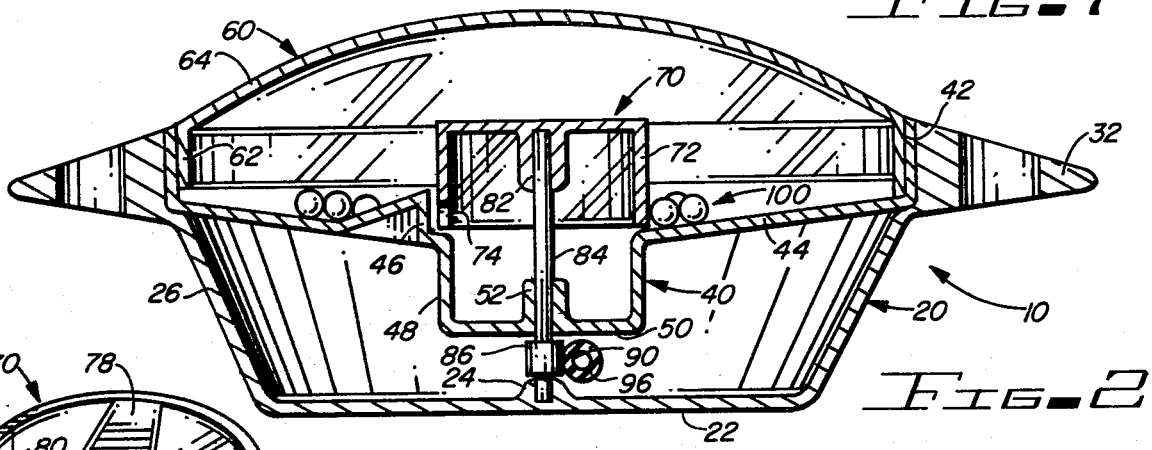
FIG. 2
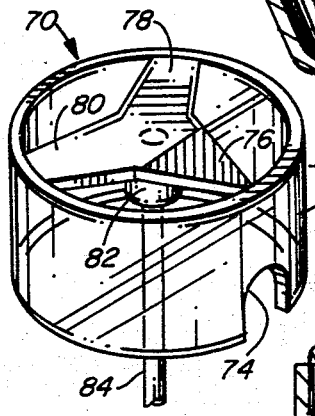
FIG. 6
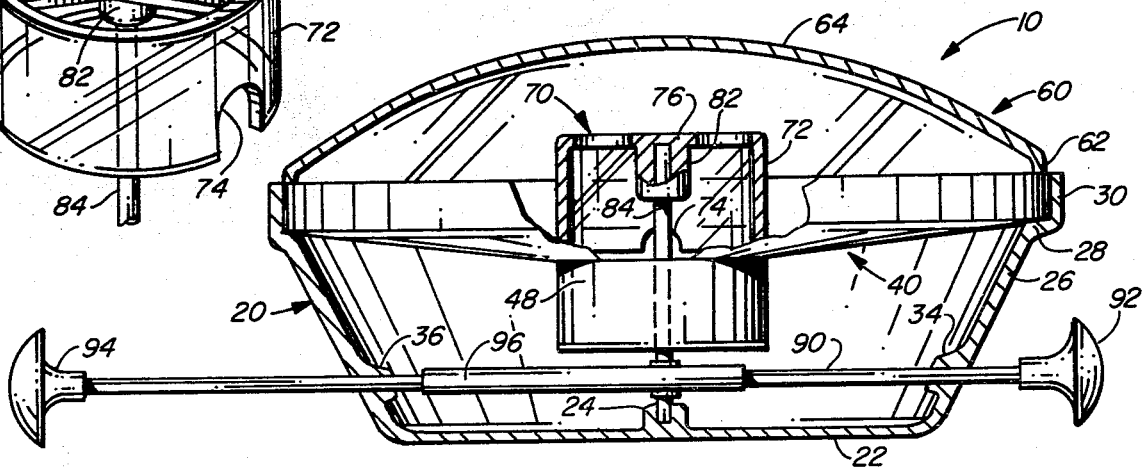
FIG. 3

ROTATING SELECTIVE ELEMENT GAME APPARATUS

BACKGROUND OF THE INVENTION

1. Field of the Invention

This invention relates to games and, more particularly, to a game requiring skill and coordingation by the user of a game to selectively admit rolling elements into a receptacle.

2. Description of the Prior Art

As is well known and understood, there are many types of games available for children to play with. Games which require skill and coordination help to increase to develop a child's skill and coordination. Many such games require a source of electrical current, such as a battery. A major problem with such games is that batteries tend to wear out at various times and, if not replaced immediately, the game is unusable. Moreover, as a battery is wearing out, the game slows down due to the lack of electrical current.

The apparatus of the present invention does not require a source of electrical current. Rather, the necessary energy for playing the game by rotating an element is provided by the user of the game. The user of the game thus expends energy, although of a minimum amount, and at the same time, develops skill and coordination.

SUMMARY OF THE INVENTION

The invention described and claimed herein comprises a game for selectively admitting rolling elements from a sloping floor into a receptacle through or by means of a rotating element. Some of the rolling elements are supposedly or theoretically to be excluded from the receptacle, while others are desired to be admitted into the receptacle, and the skill of a user in rotating or moving the rotating element to selectively admit the desired elements and exclude the undesired elements is accomplished by reciprocating a lever arm or rod which in turn causes the rotating element to move in opposite directions.

Among the objects of the present invention are the following:

To provide new and useful game apparatus;

To provide new and useful game aparatus for selectively admitting rolling elements into a receptacle;

To provide new and useful game apparatus that includes the changing of reciprocating motion to rotating motion; and To provide new and useful game apparatus for rotating an element to selectively admit rolling elements into a receptacle.

BRIEF DESCRIPTION OF THE DRAWING

FIG. 1 is a perspective view of the apparatus of the present invention.

FIG. 2 is a view in partial section of the apparatus of the present invention taken generally along line 2—2 of FIG. 1.

FIG. 3 is a view in partial section of the apparatus of the present invention taken generally along line 3—3 of FIG. 1.

FIG. 6 is an enlarged perspective view of another portion of the apparatus of the present invention.

FIG. 7 is a perspective view of elements involved with the apparatus of the present invention.

DESCRIPTION OF THE PREFERRED EMBODIMENT

Figures 4, 5:
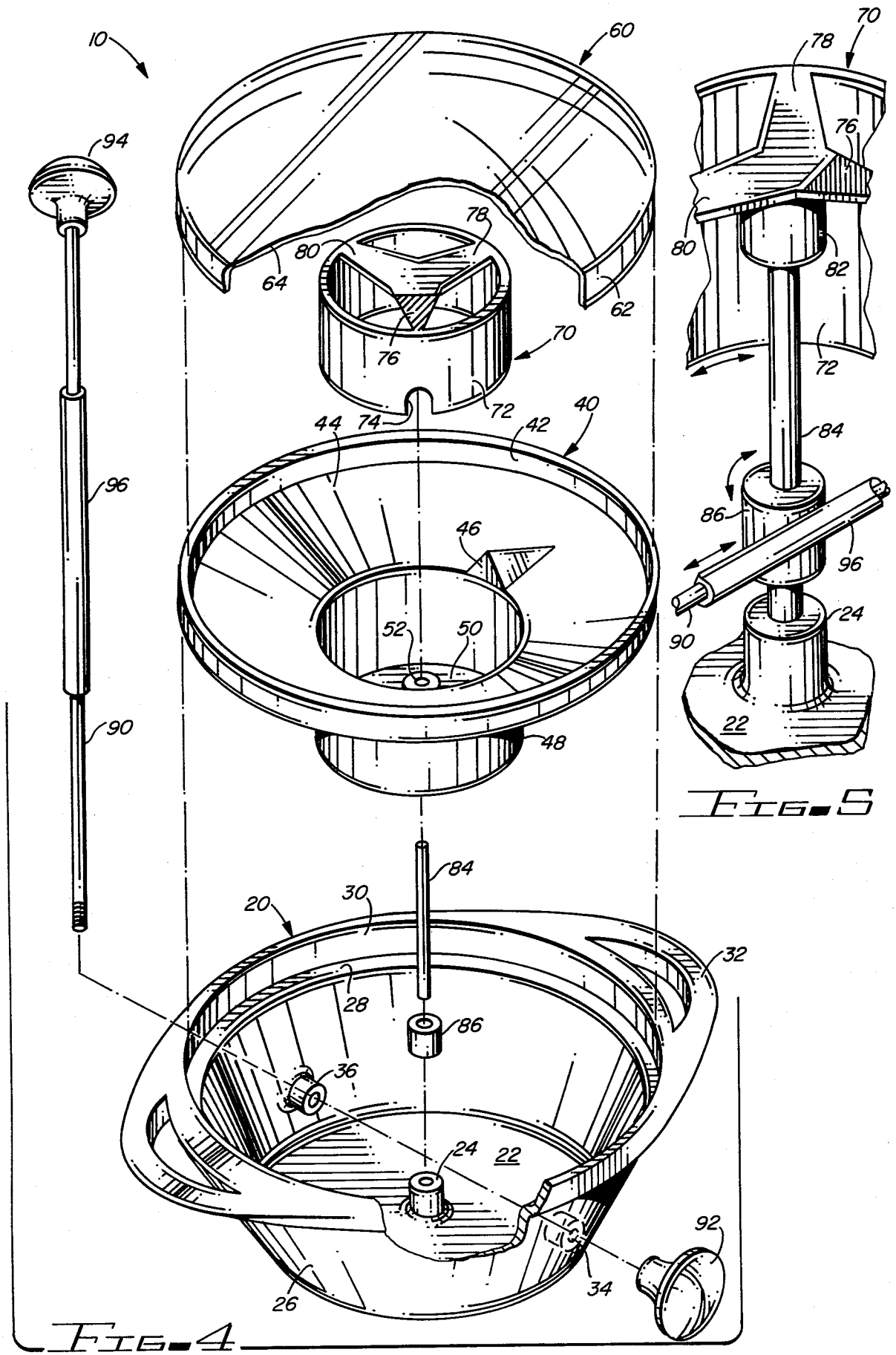
FIG. 4 is an exploded perspective view of the apparatus of the present invention.
FIG. 5 is an enlarged perspective view of a portion of the apparatus of the present invention.

FIGS. 1–7 of the drawing illustrate game apparatus 10 of the present invention. FIG. 1 is a perspective view of the game apparatus 10, illustrating the apparatus 10 in its assembled configuration. FIG. 2 is a side view in partial section of the game apparatus 10 taken generally along line 2–2 of FIG. 1. FIG. 3 is another side view in partial section of the game apparatus 10, taken generally along line 3—3 of FIG. 1. FIGS. 2 and 3 are substantially perpendicular to each other. FIG. 4 is an exploded perspective view of the game apparatus 10, with the various elements shown spaced apart from each other and portions of the various elements are cut away to illustrate some of the various elements. FIGS. 5 and 6 are enlarged perspective views of portions of the apparatus 10, illustrating the operation of some of the elements involved in the game apparatus 10. FIG. 7 is a perspective view of some of the rolling elements involved with the game apparatus 10. For the following discussion, reference will generally be made to FIGS. 1–7.

The game apparatus 10 includes several elements, including a bowl 20, an insert 40, which is disposed within the bowl 20, a top or cover 60, which is generally transparent and which covers the top of both the bowl 20 and the insert 40, a rotatable cage 70 which is disposed within the bowl 20 and within the insert 40, an actuating rod 90, the linear movement of which causes the cage 70 to rotate, and a plurality of rolling elements 100, which may be, for example, beads.

At the beginning of the game, the rolling elements 100 are disposed about the rotating cage 70, and by rotating the cage 70 through linear movement of the rod 90, control of the rolling elements is effected. The object of the game is to selectively allow certain of the elements 100 to fall into a cup or receptacle portion 48 of the insert 40.

The bowl 20 comprises or defines an outer and lower housing for the game apparatus 10. The top or cover 60 is transparent and it comprises a covering for the bowl 20 and the insert 40 of the game apparatus 10.

The bowl 20 includes a generally circular bottom 22 which is preferably flat or planar. In the center of the bottom 22 is a vertically upwardly extending boss 24. The boss 24 includes an aperture or bore for receiving a rod 84 of the cage 70. The boss 24 acts as a bottom bearing or bushing for the rotating rod 84.

Extending upwardly and sloping slightly outwardly from the outer periphery of the bottom 22 is a wall 26. At the upper part of the outwardly sloping wall 26 is a radially outwardly extending flange 28, the top part of which defines an inner lip. From the outer portion of the flange 28 is a vertically upwardly extending flange 30.

A pair of handles 32 extend outwardly from the vertical flange 30. The handles 32 are preferably spaced apart diametrically from each other across the bowl 20 and are simply used as hand holds for the convenience of a player.

A pair of bosses 34 and 36 are almost diametrically disposed across from each other and are secured at the lower portion of the wall 26. Extending through the bosses 34 and 36 are bores. The bores extend both through the bosses and the wall 26 and they comprise bushings on which the rod 90 moves in a linear, reciprocating manner under the guidance of the user or player of the game apparatus 10. The boss elements 34 and 36 are preferably spaced apart about ninety degrees from the handles 32. This is best illustrated in FIGS. 1 and 4 and may be visualized with reference to FIGS. 2 and 3.

Within the bowl 20 is the insert 40. The insert 40 includes a generally vertical cylindrical wall 42, the outer diameter of which is substantially the same as the inner diameter of the vertical flange 30 of the bowl 20. The insert 40 is disposed within the vertical flange 30 and on the radially outwardly extending flange 28. The outwardly extending flange 28 defines an inner lip which, together with the vertical flange 30, comprise a seat and a wall on which, and within which, the insert 40 is disposed.

Extending inwardly and slightly downwardly from the vertical cylindrical wall 40 is a tapered floor 44. The tapered floor 44 includes a relatively short, vertically extending inner wall 46. The inner wall 46 has a specific purpose which will be discussed in detail below.

As best shown in FIG. 4, the vertical wall 46 is generally of a triangular configuration, but it is also curved to fit the general overall curvature of a circular or cylindrical wall 48 which extends downwardly from the tapered floor 44. The wall 48 comprises the wall portion of a receptacle which will be discussed in detail below. The relatively short inner wall 46 is disposed adjacent to the juncture of the tapered floor 44 and the cylindrical wall or cup receptacle 48.

As best shown in FIGS. 4 and 6, the tapered floor 44 curves upwardly to fully enclose the portion of the floor radially outwardly from the vertical inner wall 46.

The bottom of the cylindrical cup receptacle 48 is closed by a floor 50. Extending upwardly in the center of the floor 50, substantially concentric with the cup receptacle 48, is a cylindrical boss 52. The boss 52 includes a bore extending therethrough. When the insert 40 is disposed in position within the bowl 20, the boss 52 is coaxially aligned with the boss 24 which extends upwardly from the bottom 22 of the bowl 20. The bore of the boss 52 also receives the rod 84 and acts as a bushing for the rod 84.

The top or cover 60 closes the bowl 20 and the insert 40. The top or cover 60 includes a cylindrical wall 62, the outer diameter of which is substantially the same as the inner diameter of the vertical cylindrical wall 42. The top or cover 60 accordingly is disposed with its vertical wall 62 inside the vertical cylindrical wall 42 of the insert 40. A dome 64 extends upwardly and inwardly from the wall 62. The cover 60 is transparent to allow a user or player of the game apparatus 10 to visually observe the inside of the game apparatus 10, and more particularly to observe the insert 40 and the cage 70.

The rotatable cage 70 is disposed beneath the dome 64 of the cover 60 and within the insert 40. The rotating cage 70 includes a cylindrical wall 72 with an aperture 74 cut through the lower portion of the cylindrical wall 72. The aperture 74 is best shown in FIG. 6, and it is also shown in FIGS. 2, 3, and 4.

Extending across the open top of the cylindrical wall 72 is an index pointer 76 and a pair of wings 78 and 80. The index pointer 76 and the wings 78 and 80 have a common center, which is the center or cylinder axis of the cylinder wall 72. The pointer 76 is aligned with the aperture 74, as best shown in FIG. 4. As indicated in the drawings, the pointer 76 preferably terminates in a point at the cylinder wall 72 above the aperture 74 and is preferably painted a different color from the wings 78 and 80, such as the color red. The wings 78 and 80 are preferably a neutral color, substantially the same, perhaps, but not necessarily, as the cylinder wall 72.

As is shown in FIGS. 4 and 6, the pointer 76, the wings 78 and 80, are spaced apart, preferably an arcuately equal amount, radially, with respect to the cylinder 72. They are also secured to the cylinder wall at their outer portions at the inner periphery of the cylinder wall 72.

Extending downwardly from the center point of the three elements 76, 78, and 80 is a boss 82. The boss 82 includes a bore which receives a rod 84. The rod 84 is secured to the boss 82 and thus to the cylinder 72 for joint rotation. The rod 84 extends through the boss or bushing 52 of the insert 40 and into the boss or bushing 24 of the bowl 20.

Disposed about and secured to the lower portion of the rod 84 between the bottom 50 of the receptacle 48 and the boss 24 is a friction collar 86. The friction collar 86 cooperates with the rod 90 for rotation of the cage 70, as will be discussed below.

As discussed above, the rod 90 extends through the bores of the bosses 34 and 36. The rod 90 thus extends though the bottom of the bowl 20 substantially horizontally. The bosses 34 and 36 are slightly off-center, since the boss 24 is on the central or cylinder axis of the bowl 20, the insert 40, and the cage 70. This may best be visualized by reference to FIG. 2.

The rod 90 includes a pair of handles 92 and 94 which are secured to the ends of the rod 90 on the outside of the bowl 20. The handles 92 and 94, or either of them, may be grasped by a user or player of the game apparatus 10. The rod 90 includes a friction collar 96 disposed about the rod 90 and extending generally the length of the stroke of the rod 90. The length of the stroke of the rod 90 allows for the rotation of the rod 84 and thus for the rotation of the cage 70.

The friction collars 86 and 96 are in bearing contact with each other. As the rod 90 is moved longitudinally, or as it reciprocates with respect to the bowl 20, the reciprocating movement of the rod 90 is turned into rotary movement of the rod 84 by the moving contact between the friction collars 96 and 86. Thus, longitudinal or axial movement of the rod 90 results in rotary movement of the cage 70.

It will be noted that the cage 70 moves in a direction in accordance with the direction of the movement of the rod 90. Movement of the rod in one direction results in rotation of the cage 70 in one direction, while movement of the rod in the opposite direction results in corresponding opposite directional movement of the cage 70.

Referring to FIG. 5, the movement of the cage 70 by its rod 84 is illustrated in conjunction with the rod 90 and its friction collar 96. The friction collars 86 and 96 are shown disposed against each other.

The rod 84 is shown extending into the bore of the boss 24 which in turn extends upwardly from the bottom 22 of the bowl 20. The rod 84 is in turn secured to the boss 82 of the rotatable cage 70. The boss 82 extends downwardly from the juncture of the pointer 76 and the supporting wings or arms 78 and 80. The radially outer tips or portion of all three elements are secured to the cylinder wall 72 of the cage 70. Accordingly, rotation of the rod 84 results in rotation of the cage 70. As shown by the double-headed arrows, a linear movement, or reciprocating movement, of the rod 90 causes, through the frictional engagement of the collars 96 and 86, rotary movement of the rod 84 and therefore of the cage 70.

In FIG. 7 are shown a plurality of spherical rolling elements, such as marbles or beads. The elements 100 are preferably of two different colors, with more of the elements being of one color than the other. For example, a ratio of two to one or three to one may be used. Ths striped or hatched color coding of the elements 100 in FIG. 7 indicates that there are eight elements 102 and four elements 104. The elements 102 are hatched for the color red, while the elements 104 are hatched for the color green. The colors are immaterial, the idea being that there are more elements of one color than there are of the other color.

Referring again to FIG. 4, and also to FIG. 1, the sloping floor 44 causes the rolling elements or marbles 100 to move downwardly toward the outer periphery of the rotatable cage 70 and its outer cylindrical wall 72. The sloping portion of the tapered floor 44 which is secured to the inner wall 46 also allows the elements to roll downwardly to the wall 72. Thus, when the aperture 74 is aligned with one of the marbles or rolling elements 100, by gravity they move through the aperture 74 and into the receptacle or cup 48.

The width of the aperture 74 is about the same as the diameter of the rolling elements, or slightly greater, to allow a single rolling element to move through the aperture 74 at any given time. However, the width of the aperture 74 is not sufficient to allow more than one element to go through at any one time nor is it wide enough to even allow two of the elements to block each other or to get jammed together. The height of the aperture 74 is also correlated with the diameter of the rolling elements and is again only sufficient in height to allow a single rolling element 100 to move through the aperture at any one time.

As best shown in FIGS. 1 and 2, the rolling elements are disposed on the tapered floor 44 of the insert 40 and beneath the dome 64 of the top or cover 60. As shown in FIG. 6, the aperture 74 through the cylinder wall 72 of the cage 70 is disposed adjacent to the inner, vertical wall 46 of the tapered floor 44 at the beginning of play. With the aperture 74 thus aligned with the wall 46, the cage 70 is in a neutral position. In the neutral position, the wall 46 protects the aperture 74 so that the elements 100 cannot roll through the aperture 74 and into the receptacle 48.

Movement of the rod 90, by a user or player grasping and moving either handle 92 or 94, causes the cage 70 to be rotated. The concept of the game is to align the aperture 74 with rolling elements of a particular color so as to have all of the rolling elements of one color fall into the cup 48. Preferably, the user will be able to get more of the dominant colored elements to drop into the cup or receptacle 48 than of the other color. The score at the end of the game, which is after all of the dominant or majority colored elements have dropped into the receptacle, is determined by the number of the other, the minority, colored elements remain on the tapered floor 44. Thus, if all of the elements 102 are disposed within the receptacle 48 and there are two elements 104 remaining, the one player's score would be "two". If another player gets all of the elements 102 into the receptacle 48, leaving four of the elements 104 on the tapered floor 44, that player's score becomes "four" and that player wins over the other player. That is, the highest score wins.

After a user has completed a game, by allowing all of the rolling elements 102, beads or marbles, etc., to fall into the receptacle 48, the game apparatus 10 is simply inverted. When the apparatus 10 is inverted, the rolling elements 100 will fall by gravity from the receptacle 48 through the open spaces between the pointer 76 and the arms or wings 78 and 80. The rolling elements 100 will fall through the cage 70 and through the cylindrical portion 72 thereof, and will be caught by the dome 64 of the cover 60. Since the rolling elements 100 are considerably smaller than the open spaces between the cylinder 72 and the three arms which comprise the index pointer 76 and the wings 78 and 80, they will, eventually, fall or roll from the wing 78 through the cylinder 72 and into the inside of the dome 64.

It will be noted that the exterior configuration of the dome 64 is convex and thus the interior configuration of the dome is concave. The concave configuration of the dome 64 will, after the game apparatus is returned to its normal state after the inversion, allow the rolling elements 100 to once again fall to the tapered floor 44 of the insert 40.

It should be noted that the aperture 74, at the conclusion of a game, should be returned to the neutral position where the aperture 74 is disposed opposite to the inner wall 46 of the insert 40 to prevent inadvertent movement or rolling of the elements 100 into the cup receptacle 48 before a new game actually begins. As indicated above, the neutral position of the cage, with the aperture 74 disposed adjacent to the wall 46, is best shown in FIG. 2.

With the elements 100 on the tapered floor 44, play is ready to begin again.

It will be noted that only one player can play at a time. However, any number of players may play. A person may play only against himself/herself, or two, three, four, or more players can play.

While the principles of the invention have been made clear in illustrative embodiments, there will be immediately obvious to those skilled in the art many modifications of structure, arrangement, proportions, the elements, materials, and components used in the practive of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Game apparatus, comprising, in combination:

housing means;

insert means within the housing means, including an inwardly and downwardly sloping floor, and a receptacle extending downwardly from the sloping floor;

a plurality of rolling elements disposed on the sloping floor and adapted to roll into the receptacle;

rotatable cage means disposed above the receptacle, including a cylindrical wall disposed above the receptacle for preventing the rolling elements from rolling into the receptacle, and an aperture extending through the cylinder wall to allow a rolling element to roll into the receptacle; and means for rotating the cage means to selectively align the aperture with a rolling element.

2. The apparatus of claim 1 in which the housing means includes a bowl and a cover.

3. The apparatus of claim 2 in which the insert means is disposed in the bowl beneath the cover.

4. The apparatus of claim 3 in which the means for rotating the cage means includes a first rod secured to the cage means and rotatable therewith, and a second rod extending through the bowl of the housing means and disposed against the first rod, whereby reciprocating movement of the second rod results in rotary movement of the first rod and the cage.

5. The apparatus of claim 4 in which the insert means further includes a vertical wall disposed adjacent to the receptacle and defining a neutral position when the aperture of the cage is positioned adjacent to it to prevent the elements from rolling through the aperture and into the receptacle.

6. The apparatus of claim 5 in which the housing means further includes handle means for grasping by a player.

7. The apparatus of claim 6 in which the first and second rods each include friction collars for insuring joint movement.

8. The apparatus of claim 7 in which the second rod further includes handle means disposed outside the housing means and adapted to be grasped and held by the player.

* * * * *